United States Patent [19]

Guth

[11] 3,968,984

[45] July 13, 1976

[54] DOOR LATCH

[75] Inventor: Lauren W. Guth, Louisville, Ky.

[73] Assignee: General Electric Company, Louisville, Ky.

[22] Filed: Apr. 14, 1975

[21] Appl. No.: 567,934

[52] U.S. Cl. ..... 292/229; 292/336; 292/DIG. 49

[51] Int. Cl.[2] ..... E05C 3/02

[58] Field of Search ..... 292/129, 229, 216, 336, 292/DIG. 49

[56] References Cited

UNITED STATES PATENTS

| | | | |
|---|---|---|---|
| 1,873,560 | 8/1932 | Ekman | 292/DIG. 49 |
| 2,293,402 | 8/1942 | Parsons | 292/DIG. 49 |
| 2,341,416 | 2/1944 | Anderson et al. | 292/335 |
| 2,348,955 | 5/1944 | Buchanan | 292/336 |
| 2,359,150 | 9/1944 | Peglow | 292/336 |
| 2,469,113 | 5/1949 | Hooker | 292/DIG. 49 |
| 2,528,864 | 11/1950 | Curtiss | 292/336 |
| 2,698,197 | 12/1954 | Jacobson | 292/336 |
| 2,803,480 | 8/1957 | Foster | 292/229 X |
| 2,931,205 | 4/1960 | Schmitz | 292/129 X |
| 3,058,766 | 10/1962 | Chanaryn et al. | 292/216 X |
| 3,244,830 | 4/1966 | Bates | 292/99 X |

FOREIGN PATENTS OR APPLICATIONS

| | | | |
|---|---|---|---|
| 666,900 | 7/1963 | Canada | 292/DIG. 49 |

*Primary Examiner*—Roy D. Frazier
*Assistant Examiner*—Lawrence J. Staab
*Attorney, Agent, or Firm*—Robert W. Fletcher; Francis H. Boos

[57] ABSTRACT

A door latch having an over-center latching mechanism, which can be tripped by the dishwasher timer to allow the door to open slightly during the drying cycle of the dishwasher. The latch can also be opened by operating a handle on the exterior of the dishwasher.

3 Claims, 3 Drawing Figures

DOOR LATCH

BACKGROUND OF THE INVENTION

In the operation of a household dishwasher, it is desirable to provide an arrangement whereby the door can be automatically opened at the end of the last rinse cycle to promote natural drying of the dishes therein. Such an arrangement allows the heat within the dishwasher, plus convection currents, to effect drying of the dishes and obviates the need for an electrical heater.

There are, however, certain requirements that must be met with such an automatic opening arrangement. Firstly, the arrangement must allow the opening and closing of the dishwasher door during the wash cycles, as well as during the drying period. Secondly, it is necessary that the dishwasher contain electrical safeguards so that it cannot be started while the door is open.

Further, it is desirable that the force required to operate the door latch be of such a magnitude that the timer of the dishwasher can accomplish this function without the use of any electrical solenoid or other device.

U.S. Pat. Nos. 2,359,150; 2,469,113; and 2,528,864 show latch devices in major appliances. They do not, however, show a latch device operable from both inside the door and from outside the appliance and operable by a force of such magnitude that it can be supplied by a timer mechanism as disclosed and claimed herein.

Applicant has invented a simple, straightforward, readily-employed, and easily-maintained latch device for a dishwasher, which latch device allows opening and closing of the dishwasher in a normal fashion, as well as automatic opening of the dishwasher by the timer.

SUMMARY OF THE INVENTION

The dishwasher door latch of this invention includes a handle, a toggle linkage, a keeper, and a detent, all of which function cooperatively to allow a dishwasher to be opened manually from the exterior or opened automatically by the dishwasher timer from inside the dishwasher door.

More specifically, the invention includes a door latch comprising a frame; a handle pivotally connected to the frame; a lever connected to the handle and extending therefrom; a detent having first, second, and third end portions, said detent being pivotally connected to the frame at its first end portion for pivotal movement between engaged and disengaged positions; a keeper having first and second end sections and a midsection, said keeper being pivotally connected to the frame at its midsection for pivotal movement between an unlatched position at which the detent engages said keeper and a latched position at which said keeper is spaced from said detent; toggle linkage means pivotally connecting the second section of said keeper to the lever for pivotal movement of said keeper in response to movement of said lever between extended and retracted positions; biasing means for urging said detent toward its engaged position when the door is open and, additionally, biasing said toggle linkage means in an over-center relationship when the door is in its closed position; and striker means for causing said detent to move toward its unlatched position in response to closing the door.

DESCRIPTION OF THE PREFERRED EMBODIMENT

Figure 1:
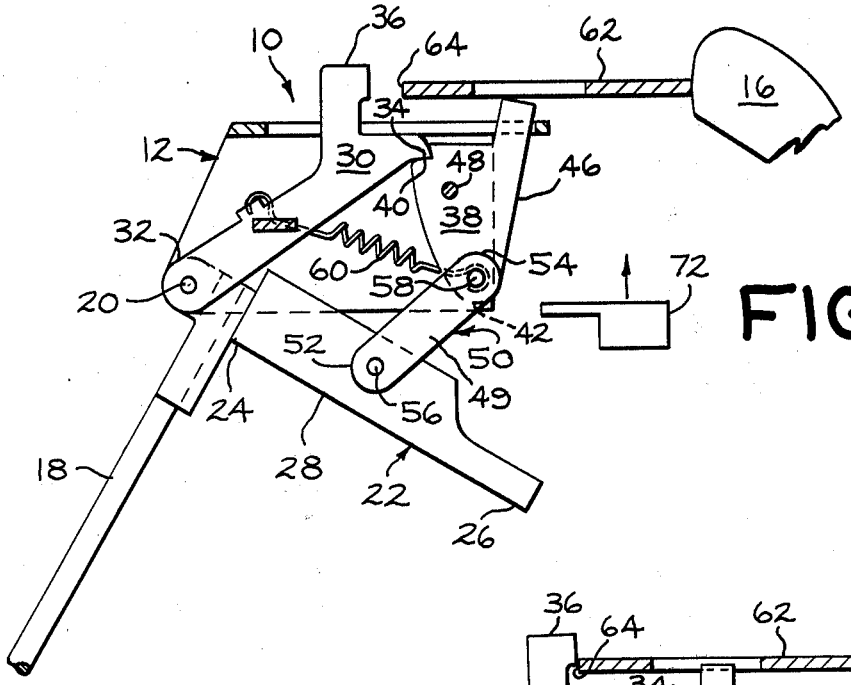
FIG. 1 is a diagrammatic side view of the latch of this invention in the open position.
Figure 3:
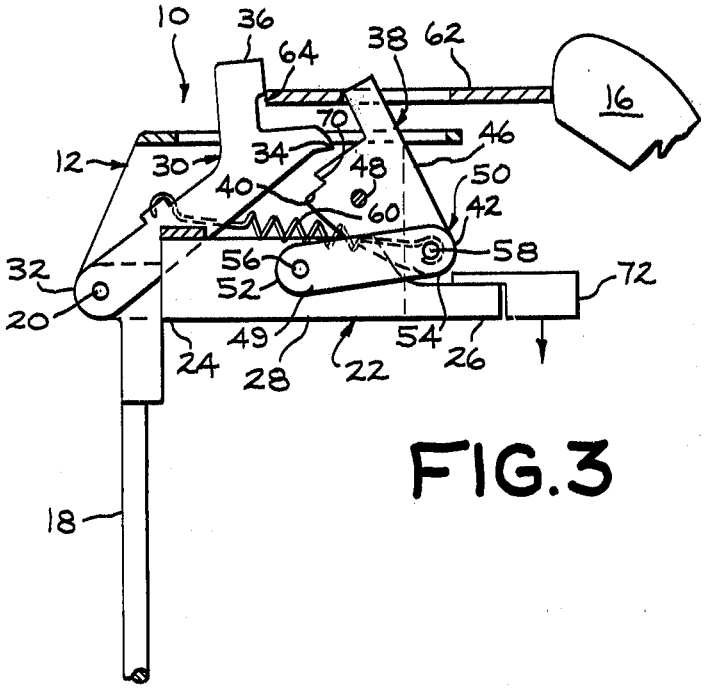
FIG. 3 is a diagrammatic side view of the latch in the closed position.

In the embodiment of FIGS. 1 and 3, the door latch 10 has a frame 12 connected to a door which is associated with an access opening of a household appliance 16. The latch 10 has a handle 18 pivotally connected by pin 20 to the frame 12.

A lever 22 has first and second end portions 24, 26 and a middle portion 28. The lever 22 is fixedly connected at the first end portion 24 to the handle 18. The lever 22 extends outwardly from the handle 18 and pivots between first and second positions with the handle 18. FIG. 3 shows the lever 22 at the first or closed position and FIG. 1 shows the lever 22 at the second or open position.

A detent 30 of the latch 10 has first, second, and third end portions 32, 34, 36. The detent 30 is pivotally connected at the first end portion 32 to the frame 12 by pin 20. The detent 30 is pivotally movable between a first position, as shown in FIG. 1, at which said second end portion 34 of the detent 30 is at a lower, first elevation in engagement with keeper 38, and a second position, as shown in FIG. 3, at which the second end portion 34 of the detent 30 is at a higher, second elevation.

Keeper 38 is positioned adjacent the detent 30. The keeper 38 has first and second end portions 40, 42, and a middle portion 46. The keeper 38 is pivotally connected at the middle portion 46 to the frame 12 by pin 48.

The keeper 38 is pivotally movable about pin 48 between a first position shown in FIG. 3, at which the first end portion 40 is spaced from and at a lower elevation than the second end portion 34 of the detent 30, and a second position shown in FIG. 1, at which the first end portion 40 is rotatably moved from said first position and is being held at said second position by the second end portion 34 of the detent 30.

The first end portion 40 of the keeper 38 has a notch 70, better seen in FIG. 3. The notch 70 is of dimensions sufficient for nesting the second end portion 34 of the detent 30 therein at the second position of elements 30, 38 (FIG. 1) for locking the latch 10 in the open position.

A link 49 having first and second end portions 52, 54 is pivotally connected at respective end portions by pins 56, 58 to the respective middle portion 28 of the lever 22 to form a toggle linkage 50. The link 49 has its opposite end attached to the second end portion 42 of the keeper 38.

The toggle linkage 50 provides the connection between the keeper 38 and the lever 22 for pivotal movement of the keeper about pin 48 in response to movement of the lever 22 between its first and second positions.

A biasing means 60, for example a helically-coiled spring, performs three specific functions. Firstly, spring 60 is connected to the keeper 38 for biasing it toward the second or open position. To accomplish such biasing, the spring 60 is connected at one end to the pivotal connection 58 of link 49 and keeper 38, and at the other end, to the detent 30.

Secondly, because spring 60 is connected to detent 30, detent 30 is biased toward its keeper engaging position as shown in FIG. 1. Such biasing insures that the door latch cannot be locked until the dishwasher door is closed and striker 62 has disengaged detent 30 from keeper 38. Such an arrangement allows the dishwasher controls to be keyed to movement of either the detent or keeper by, for example, an interlock switch (not shown).

Thirdly, spring 60 provides a biasing force between pins 20 and 58 and thus provides a force which must be overcome when toggle linkage 50 passes over-center. This arrangement provides a latching system that is opened with a force of low value applied to end 26 of lever 22.

Figure 2:
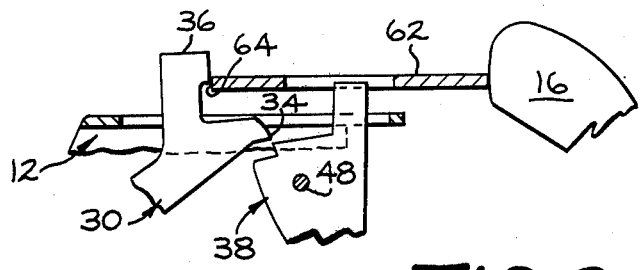
FIG. 2 is a diagrammatic side view of a portion of the latch as the latch is being closed.

Referring to FIg. 2, striker 62 has a first end portion 64 and is attached to the appliance 16 and is positioned adjacent a third end portion 36 of the detent 30 at a level just above the keeper 38. The striker end portion 64 contacts the detent 30 and causes it to move from the second toward the first position in response to closing the door.

Referring to FIGS. 1 and 3, a cam or element 72 is associated with control equipment such as a timer (not shown). Element 72 is located adjacent the second end portion 26 of the lever 22 for contacting and moving the lever in a direction away from the keeper 38 and thereby moving the keeper 38 from the first, latched position toward the second, unlatched position.

By so constructing the latch 10 of this invention, a relatively minor force is required to open the latch at end portion 26. In addition, the latch can be opened by a force executed on the handle 18. In the open position, the latch is locked open by the second end portion 34 of the detent 30 nesting in notch 70 of the keeper 38, thereby preventing the keeper 38 and lever 22 from moving to the closed position shown in FIG. 3.

In operation, the dishwasher door may be swung toward its closed position whereby striker 62 engages detent 30 and thereby releases keeper 38. Continued pressure downwardly on handle 18 causes lever 22 to be rotated in a counterclockwise direction, thereby forcing toggle connection 50 into its over-center position and extending spring 60. Keeper 38, meanwhile, is free to rotate through an opening provided in striker 62 and abut against one edge thereof to releasably secure the door in close position.

During the washing operation, the timer will cause the dishwasher to pass through the various wash and rinse cycles and finally cause movement of cam 72, which movement will, as shown in FIG. 3, force the toggle linkage out of its over-center position, thus unlatching the dishwasher door.

Suitable hinge means can be mounted on the dishwasher door (not shown) to cause the door to move to an open position of about two or three inches, thus promoting natural drying of the dishes inside the dishwasher.

Having described the above invention, what is claimed is:

1. A door latch for a dishwasher door comprising:

a frame;

a handle pivotally connected to the frame;

a lever connected to the handle and extending therefrom;

a detent having first, second, and third end portions, said detent being pivotally connected to the frame at the first end portion for pivotal movement between engaged and disengaged positions;

a keeper having first and second end sections and a midsection, said keeper being pivotally connected to the frame at its midsection for pivotal movement between an unlatched position at which the detent engages said keeper and a latched position at which said keeper is spaced from said detent;

toggle linkage means pivotally connecting the second section of said keeper to the lever for pivotal movement of said keeper in response to movement of said lever between extended and retracted positions;

biasing means for urging said detent toward its engaged position when the dishwasher door is open and additionally biasing said toggle linkage means in an over-center relationship when the door is in its closed position;

striker means for causing said detent to move toward its disengaged position in response to closing the door; and means for contacting the lever and moving it in a direction away from the keeper, thereby causing said keeper to move from its latched position toward its unlatched position.

2. Apparatus, as set forth in claim 1, wherein the first end section of the keeper has a notch of dimensions sufficient for nesting of the second end portion of the detent therein.

3. Apparatus, as set forth in claim 2, wherein said striker means engages said third end portion of said detent to cause said detent to move toward its disengaged position in response to closing the door.

* * * * *